US010323914B2

(12) United States Patent
Müller et al.

(10) Patent No.: US 10,323,914 B2
(45) Date of Patent: Jun. 18, 2019

(54) METHOD FOR OPERATING A THROWING SYSTEM FOR DISCUSES

(71) Applicant: OKM GMBH, Altenburg (DE)
(72) Inventors: Ingolf Müller, Fockendorf (DE); Christian Becker, Altenburg (DE)
(73) Assignee: OKM GMBH, Altenburg (DE)

( * ) Notice: Subject to any disclaimer, the term of this patent is extended or adjusted under 35 U.S.C. 154(b) by 0 days.
(21) Appl. No.: 15/739,497
(22) PCT Filed: Jul. 7, 2016
(86) PCT No.: PCT/EP2016/066076
§ 371 (c)(1),
(2) Date: Dec. 22, 2017
(87) PCT Pub. No.: WO2017/005833
PCT Pub. Date: Jan. 12, 2017
(65) Prior Publication Data
US 2018/0180390 A1 Jun. 28, 2018
(30) Foreign Application Priority Data
Jul. 7, 2015 (DE) ..... 10 2015 212 678
(51) Int. Cl.
*F41J 9/18* (2006.01)
(52) U.S. Cl.
CPC ..... *F41J 9/18* (2013.01)
(58) Field of Classification Search
CPC ..... F41J 9/18; F41J 11/02
(Continued)

(56) References Cited

U.S. PATENT DOCUMENTS 5,359,576 A * 10/1994 Bunner ..... F41J 9/18 124/34
5,427,380 A * 6/1995 Hazard ..... F41J 9/18 124/32
(Continued)

FOREIGN PATENT DOCUMENTS

DE 1172158 A 6/1964
DE 1172158 B 6/1964
(Continued)

OTHER PUBLICATIONS

Notification Concerning Transmittal of International Preliminary Report on Patentability (Chapter I of the Patent Cooperation Treaty), in English, dated Jan. 18, 2018, which was issued by the International Bureau of WIPO in Applicant's corresponding international PCT application having Serial No. PCT/EP2016/066076, filed on Jul. 7, 2016.
(Continued)

*Primary Examiner* — Alexander R Niconovich
(74) *Attorney, Agent, or Firm* — Bodner & O'Rourke, LLP; Gerald T. Bodner; Christian P. Bodner

(57) ABSTRACT

A method for operating a throwing system for clay pigeons including at least one throwing machine arrangement respectively including at least one throwing machine and at least one throwing machine control unit, a central control unit for controlling the throwing machine arrangement and a microphone arrangement that is connected to the control unit for acoustically inputting a throwing command, wherein the central control unit performs a wireless and bidirectional data exchange with a stationary communication terminal and/or a mobile communication terminal, and the stationary communication terminal and/or the mobile communication terminal and the central control unit perform a data exchange relating to an operation of the throwing system with an external administration server for the throwing system through a communication network.

9 Claims, 8 Drawing Sheets

(58) Field of Classification Search
USPC ..... 124/6, 8, 32, 34
See application file for complete search history.

(56) References Cited

U.S. PATENT DOCUMENTS

| | | | | |
|---|---|---|---|---|
| 5,857,451 | A * | 1/1999 | Ciluffo | A63B 69/0026 124/6 |
| 6,159,112 | A * | 12/2000 | Ciluffo | A63B 69/0024 473/451 |
| 8,151,726 | B2 * | 4/2012 | Cossaboom | F41J 11/02 116/173 |
| 9,441,923 | B2 * | 9/2016 | Chadwick | F41J 11/00 |
| 9,612,092 | B2 * | 4/2017 | Chester | F41J 5/14 |
| 2005/0282118 | A1 * | 12/2005 | Erdoss | F41J 9/18 434/16 |
| 2010/0102512 | A1 * | 4/2010 | Dar | F41J 9/18 273/362 |
| 2014/0217674 | A1 * | 8/2014 | Kochuba | F41J 9/00 273/359 |
| 2015/0091252 | A1 * | 4/2015 | Chadwick | F41J 11/00 273/359 |
| 2015/0102563 | A1 * | 4/2015 | Gwash | F41J 7/06 273/390 |
| 2015/0285593 | A1 * | 10/2015 | Dribben | F41J 5/10 434/19 |

FOREIGN PATENT DOCUMENTS

| | | |
|---|---|---|
| DE | 2352502 A1 | 4/1975 |
| FR | 2867265 A1 | 9/2005 |

OTHER PUBLICATIONS

English translation of the International Preliminary Report on Patentability (Chapter I of the Patent Cooperation Treaty), dated Jan. 9, 2018, which was issued by the International Bureau of WIPO in Applicant's corresponding international PCT application having Serial No. PCT/EP2016/066076, filed on Jul. 7, 2016.

Written Opinion of the International Searching Authority, in English, dated Sep. 16, 2016, which was issued by the International Bureau of WIPO in Applicant's corresponding international PCT application having Serial No. PCT/EP2016/066076, filed on Jul. 7, 2016.

International Search Report, in English, dated Sep. 16, 2016, which was issued by the International Bureau of WIPO in Applicant's corresponding international PCT application having Serial No. PCT/EP2016/066076, filed on Jul. 7, 2016.

Office Action (in German), dated Apr. 29, 2016, issued by the German Patent Office for Applicant's corresponding German Patent Application No. DE 10 2015 212 678.1, filed Jul. 7, 2015.

* cited by examiner

METHOD FOR OPERATING A THROWING SYSTEM FOR DISCUSES

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION (1 ) Field of the Invention

The invention relates to a method for operating a throwing arrangement for clay pigeons according to claim 1.

(2 ) Description of Related Art

Throwing arrangements for clay pigeons, are used for clay pigeon shooting. This precision sport is practiced in many ways. There are different disciplines based on competition conditions and rules like for example skeet, hunt parcours, helices or compak sporting or trap or double trap. These disciplines differ in the type of call of the clay pigeons, in the type of throw from one or plural throwing arrangements distributed in the field or also in the number and throw frequency of the clay pigeons thrown.

In order to provide a throwing arrangement for various disciplines and to adapt an operating mode of the throwing arrangements to the different disciplines modern throwing arrangements have different components. Typically the throwing arrangements include at least one throwing machine. The throwing machine includes at least one throwing machine control unit for controlling operations of the throwing machine. In order to implement different operating modes and disciplines on the throwing machine a central control unit is provided which controls the throwing machine arrangement. The call is performed through a microphone system that is connected with the control unit and which is used for acoustically entering a throwing signal that is called out by the shooter and whose signals are processed by the central control unit. In order to connect the components wireless signal transmission channels are also partially used.

It is a substantial problem of these arrangements that they are typically only operable and adaptable to different disciplines with substantial know how. The central control units of the throwing arrangements are commercially available but their correct operation can only be performed with the knowhow of a person skilled in the art. Thus, a shooter does not only have to understand the sporting basics but he also has to be competent in operating the components or operators have to be present which perform respective adjustments in particular of the control unit.

The required technical knowhow for operations and the substantial personnel requirements are an obstacle for beginners that are interested in the sport of clay pigeon shooting. Furthermore larger arrangements require personalized recording of clay pigeon use for organizational and economic reasons. This was performed up to now by operators who register the clay pigeon consumption and compute the fees therefrom that are to be paid by respective shooters.

BRIEF SUMMARY OF THE INVENTION

Thus, it is an object of the invention to provide a method for operating a throwing arrangement for clay pigeons which overcomes the problems described supra so that the throwing arrangement can be used by a wider audience and so that the throwing arrangement can be adjusted to different disciplines in a flexible manner and individualized types of clay pigeon shooting and training can be implemented by the clay pigeon throwing system. Furthermore the existing arrangements shall be provided with a method where consumption recording and a payment system can be implemented in an automated manner with reduced personnel requirement.

The object is achieved by a method for operating a throwing arrangement of the clay pigeons with the features of claim 1. The dependent claims include useful and advantageous embodiments of the method.

The method for operating a throwing arrangement for clay pigeons is based on a throwing arrangement which includes the following components:

At least one throwing machine arrangement is provided that includes at least one throwing machine. The throwing machine includes respectively and at least one throwing machine control unit. Furthermore a central control unit for controlling the throwing machine arrangement is provided and a microphone system which is connected with the control unit and configured to put in an acoustical throwing command, According to the invention the method is performed so that the central control unit performs a wireless and bidirectional data exchange with a stationary communication terminal and/or a mobile communication terminal. Furthermore the stationary and/or the mobile communication terminal performs a data exchange with a management server for the throwing arrangement through a communication network wherein the data exchange relates to operations of the throwing arrangement.

Thus, it is a basic idea of the method to supplement the throwing arrangement with a bidirectional data exchange with a communication terminal and to simultaneously provide a management server which exchanges data on the one hand side with the communication terminal and on the other hand side with the central control unit. Thus, the communication terminal becomes the actual actuation device of the throwing arrangement for the shooter whereas on the other hand side the communication terminal and the central control unit are detectable by the management server and thus the operating conditions of the throwing arrangement can be detected in a personalized manner self-acting.

In one embodiment the stationary and/or mobile communication terminal includes a control program with training routines that are freely selectable on the communication terminal and operating modes for actuating the central control unit. Thus, the shooter can select the control program on his communication terminal. The control program is transmitted to the central control unit so that the central control unit controls the throwing arrangement in a modified manner. The communication terminal thus becomes an input interface for the shooter through which the shooter can control operations of the throwing arrangement.

In another embodiment the control program transmits a hot switching and throwing sequence to the central control unit, wherein the hot switching and throwing sequence causes the central control unit to facilitate activation and actuation of the microphone arrangement and/or of the throwing machine control unit.

Thus, the method influences the central control unit and the microphone arrangement so that the throwing process is divided into a sequence where the microphone arrangement is switched active or blocked so that the microphone arrangement can either detect the call of the shooter or so the microphone arrangement is blocked for the call. Thus, influences of environmental sounds and an unintentional throwing of clay pigeons are prevented.

In another embodiment a data exchange relating to operations of the throwing arrangement is performed during operations of the throwing arrangement between the stationary and/or the mobile communication terminal and/or the central control unit and the external management server for personalized operating parameter capture and consumption accounting.

Thus the external management server receives personalized data from the communication terminal wherein the personalized data is used for at least registering the shooter, whereas the control unit captures operating data like e.g. a number of clay pigeons that has already been launched. In the external management server the two data sets are associated with each other and are thus form a basis for personalized operating data capture and consumption accounting.

In another embodiment at least one microphone is activated by the hot switching and throwing sequence during a pre determinable time interval in order to provide receiving readiness for an acoustic throwing command. Thus, the microphone is only activated when a throwing command may actually be given.

In another embodiment activating the microphone is indicated by an optical and/or acoustic signal generator that is arranged in a portion of the microphone. The shooter sees or hears that the microphone is ready to receive the call command and the shooter can now give the call command.

In another embodiment an activation of the sound and/or light output is performed by the hot switching and throwing sequence at the stationary and/or mobile communication terminal of the shooter in order to signal individual operating conditions of the throwing arrangement. It can thus be signaled to the shooter that the hot switching and throwing sequence has been confirmed by the central control unit and the sequence has been initiated or completed.

In another embodiment the throwing machine control unit issues a feedback signal to the control unit after a clay pigeon has been thrown wherein the central control unit transmits the feedback signal to the stationary and/or mobile communication terminal and/or to the management server in order to perform personalized operations detection and consumption accounting. Thus, a tracking of the use of the throwing arrangement is facilitated on the communication terminal as well as on the management server.

In another embodiment the control program performs an authentication and registration process on the stationary and/or mobile communication terminal with the management server, wherein the management server generates an access code as a result for an access of the communication terminal to the control unit. This method configuration assures a use of the call arrangement by authorized persons and therefore serves as an access control and registering personalization.

When configured on the communication terminal the control program is configured as an app. The app can be installed in a simple manner on the communication terminal and can for example be adapted to a particular call arrangement.

The method shall be subsequently described in more detail with reference to embodiments. FIGS. 1-8 are used for illustration purposes. Identical reference numerals are being used for identical and/or equivalent elements, wherein:

BRIEF DESCRIPTION OF THE SEVERAL VIEWS OF THE DRAWINGS(S)

DETAILED DESCRIPTION OF THE INVENTION

Figure 1:
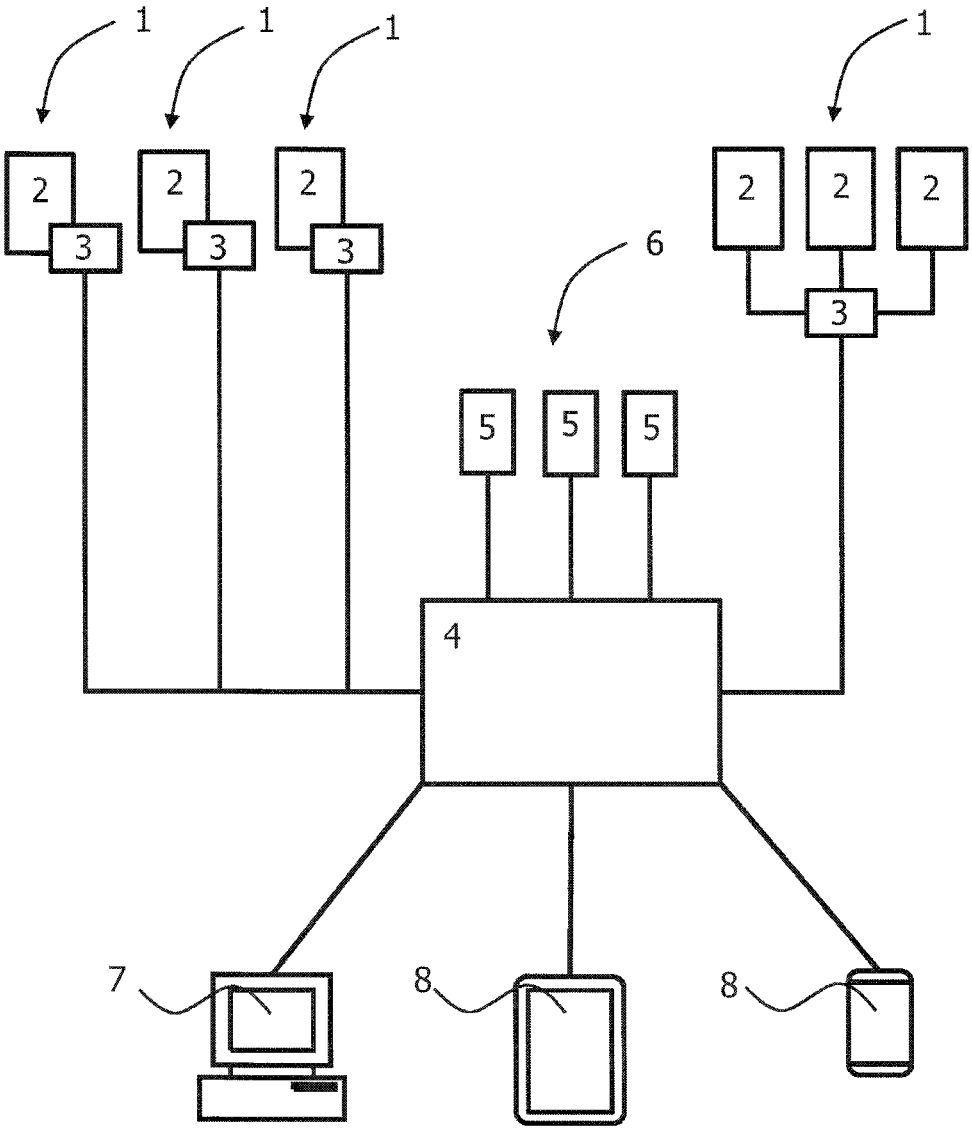
FIG. 1 illustrates an overview of components employed to practice the method.

FIG. 1 illustrates an overview of components of the throwing arrangement used for performing the method. The throwing arrangement includes plural throwing machine arrangements 1 which respectively include at least one throwing machine 2 and a throwing machine control unit 3. As evident from the drawing figure also operations of plural throwing machines can be controlled by a throwing machine control unit. The throwing machine includes the actual mechanism for throwing the clay pigeons, the throwing machine control unit includes all component that are necessary to receive external control signals and transforming them into actions of the throwing machine, thus in particular for throwing one or plural clay pigeons and for reporting an operating condition of the throwing machine arrangement.

Operations of the throwing machines of the throwing arrangement are monitored and controlled by a central control unit 4. The central control unit receives in particular acoustic call commands through a series of microphones 5 of a microphone arrangement 6 that is distributed in the area of the throwing arrangement and transposes the call commands internally and according to a respectively adjusted control program that is adapted to the different shooting disciplines into triggering impulses for the throwing machine arrangements 1. The control unit associates in particular the acoustic call commands that are received through the different microphones with the respectively associated throwing machine arrangements.

The microphone arrangement 6 is made from individual microphones 5. The individual microphones 5 can be arranged at different locations that are distributed over the area of the throwing arrangement. Arranging the microphones side by side in a shooting range for several shooters is also possible. In this arrangement of the microphones it is advantageous to use directed microphones and to arrange the microphones advantageously in order to assure that the respective acoustic call command of the right shooter is captured by the right microphone.

Additionally an additional monitoring microphone can be associated either with the entire microphone arrangement 6 or also with each individual microphone 5 wherein the monitoring microphone monitors and receives ambient noises. An additional microphone of this type registers each irregular noise event in the environment of the shooting range, for example bangs, rapidly increasing and decreasing sound levels shouts of persons etc., but also the call commands given by the shooter. The monitoring microphone is wired to the central control unit and its signals are processed so that a throw at the throwing machine arrangements is only performed when the same sound signal is captured at the microphone 5 as well as at the monitoring microphone. For competitions where time limits are set and have to be kept by the individual shooters the microphone can be associated with a digital clock that is easily visible to the shooter or another type of time signaling in order to indicate the remaining time until a clay pigeon can be called up or can be shot. This time signaling is directly connected with the central control unit. When the time has expired and no clay pigeon has been called the respective microphone is deactivated.

The central control unit 4 is in a bidirectional data exchange with stationary and/or mobile communication terminals 7 and 8. As a stationary communication terminal in particular a personal computer can be used. The stationary communication terminal, however, can also be an operator terminal that is permanently installed in the area of the throwing arrangement, for example in the entrance portion to the throwing arrangement where the respective shooters can register and can influence operations of the throwing arrangement menu driven.

As a mobile communication terminal for example tablet PCs or so called smart phone mobile radio systems can be used. The communication terminals 7 and 8 represent a user interface for the shooter who can control the throwing arrangements with the communication terminals and can select and define basic operating parameters like for example various shooting disciplines.

Figure 2:
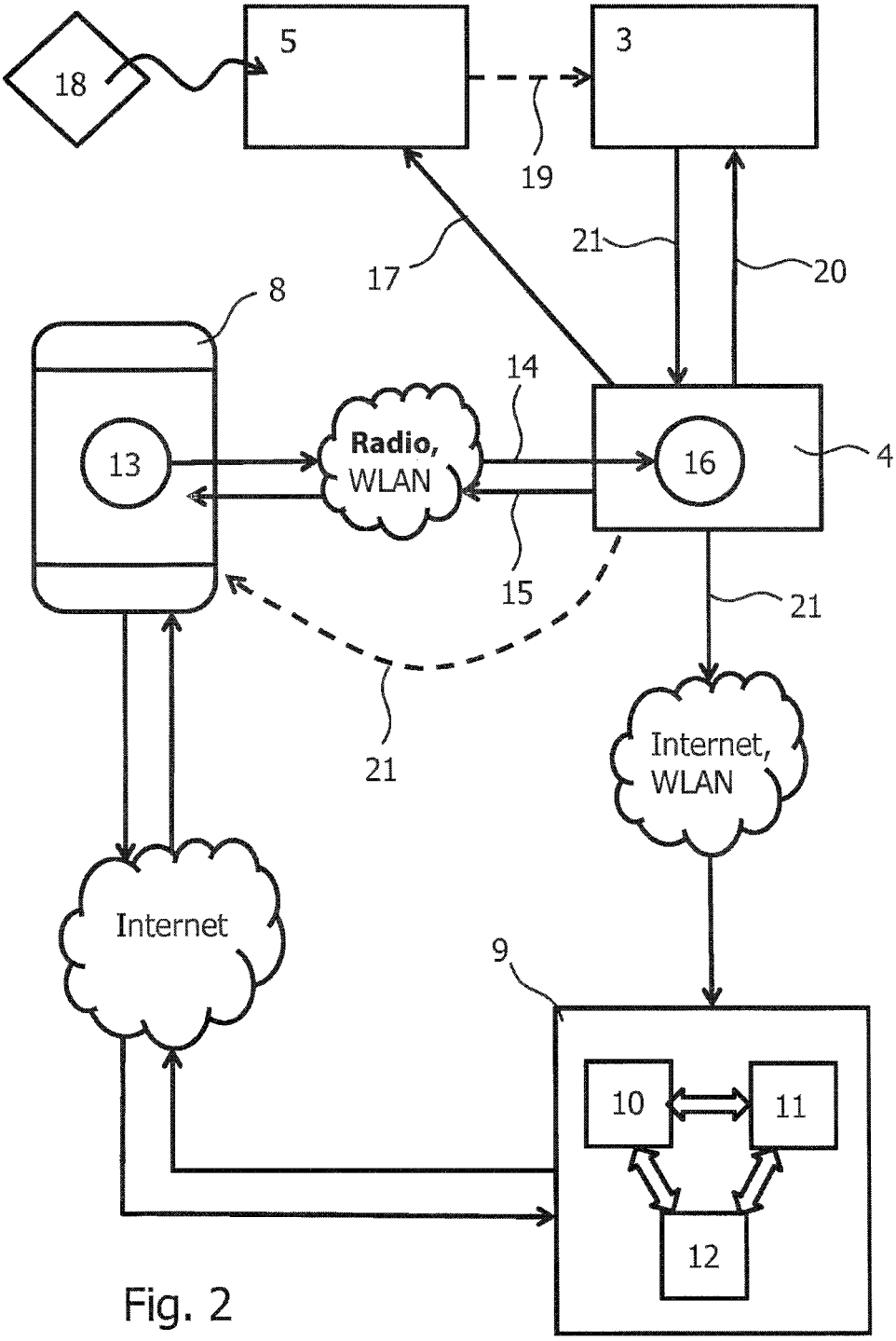
FIG. 2 illustrates an exemplary embodiment of communication processes within the components.

FIG. 2 illustrates an exemplary embodiment of communication processes according to the method within components of the throwing arrangement. The communication process are performed between the throwing machine control unit 3, the central control unit 4, at least one of the microphones 5, a mobile communication terminal 8 configured as a smart phone and an external management server 9. The external management server includes a user account control 10, operations control 11 for monitoring operating conditions of the throwing arrangement and an accounting unit 12 for individual fee accounting.

The subsequent processes of data transmission are partially performed wirelessly. A radio network, in particular a WLAN network is used as a channel for data exchange between the mobile communication network 8 and the central control unit 4. Communications between the mobile communication terminal 8 and the external management server 9 is performed by typical communication networks, for example the internet and respective communication protocols. Data exchange between the central control unit 4 and the external management server 9 is performed through the internet or in case of close proximity though the WLAN protocol.

Data transmissions between the central control unit 4, the microphone 5 and the throwing machine control 3 can be configured wireless or line based.

The mobile communication terminal 8 includes a control program 13 which can be configured for example as an app that is typical for smart phones and tablet PCs. The shooter can select with this app between different shooting disciplines like skeet, hunt parkour's, helices, compak sporting, trap or double trap. These options are respectively associated with different operating modes and control impulses for the components of the throwing arrangement. After selecting the respective option on the app the respective data is transmitted in a step 14 to the central control unit through the radio or WLAN network. The central control unit is thus adjusted to a respective control mode with respect to the microphone 5 and the throwing machine control unit 3. In particular the hot switching and throwing sequence 16 is defined within the central control unit which is used for controlling the microphone arrangement and the throwing machine control and by which it is furthermore defined in which way the components are addressed and activated.

A confirmation 15 is performed by the central control unit 4 onto the mobile communication terminal 8 regarding the selection and activation of the respective operating mode. Instead of the confirmation also an error report or a report can be provided that the instant control unit and thus the selected throwing arrangement does not have the operating mode or the shooting discipline available that was selected on the app.

As a result of this data exchange the hot switching and throwing frequency 16 is defined in the central control unit and being executed. Thus, the central control unit provides an activation signal 17 to a respective microphone 5. The microphone proximal to the shooter is switched hot and expects an acoustic input of a call command 18. As soon as the call command 18 is detected by the microphone 5 the throwing machine control unit 3 receives a throwing impulse 19.

When executing the hot switching and throwing sequence a throw control signal 20 is simultaneously transmitted by the central control unit 4 to the throwing machine control unit 3. The throw control signal determines e.g. for the throwing machine control unit in which manner the throwing has to be performed when the throwing impulse is provided. The throwing control signal states for example whether plural clay pigeons shall be thrown simultaneously or plural clay pigeons shall be thrown in sequence within a particular time interval, which throwing angle shall be used by the throwing machine and which types of clay pigeons shall be thrown, whether and to what extent the throwing of the clay pigeons shall be varied and similar parameters.

As soon as the throwing machine has performed the throw the throwing machine control returns a throw count signal 21 to the central control unit 4. The central control unit 4 thus registers the performed throw and forwards the throw count signal 21 to the external management server 9. The external management server captures the throw count signal in the internal operating control 11 and in the accounting unit 12 and correlates this data with the individual registration data of the shooter provided through the mobile communication terminal 8 through the user account control 10.

Optionally the central control unit 4 can also put the throw count signal 21 out to the mobile communication terminal 8. Thus, the mobile communication terminal 8 also registers all throws called by the shooter so that the shooter receives a receipt regarding his consumption of clay pigeons and can compare this with a subsequent billing statement.

Figure 3:
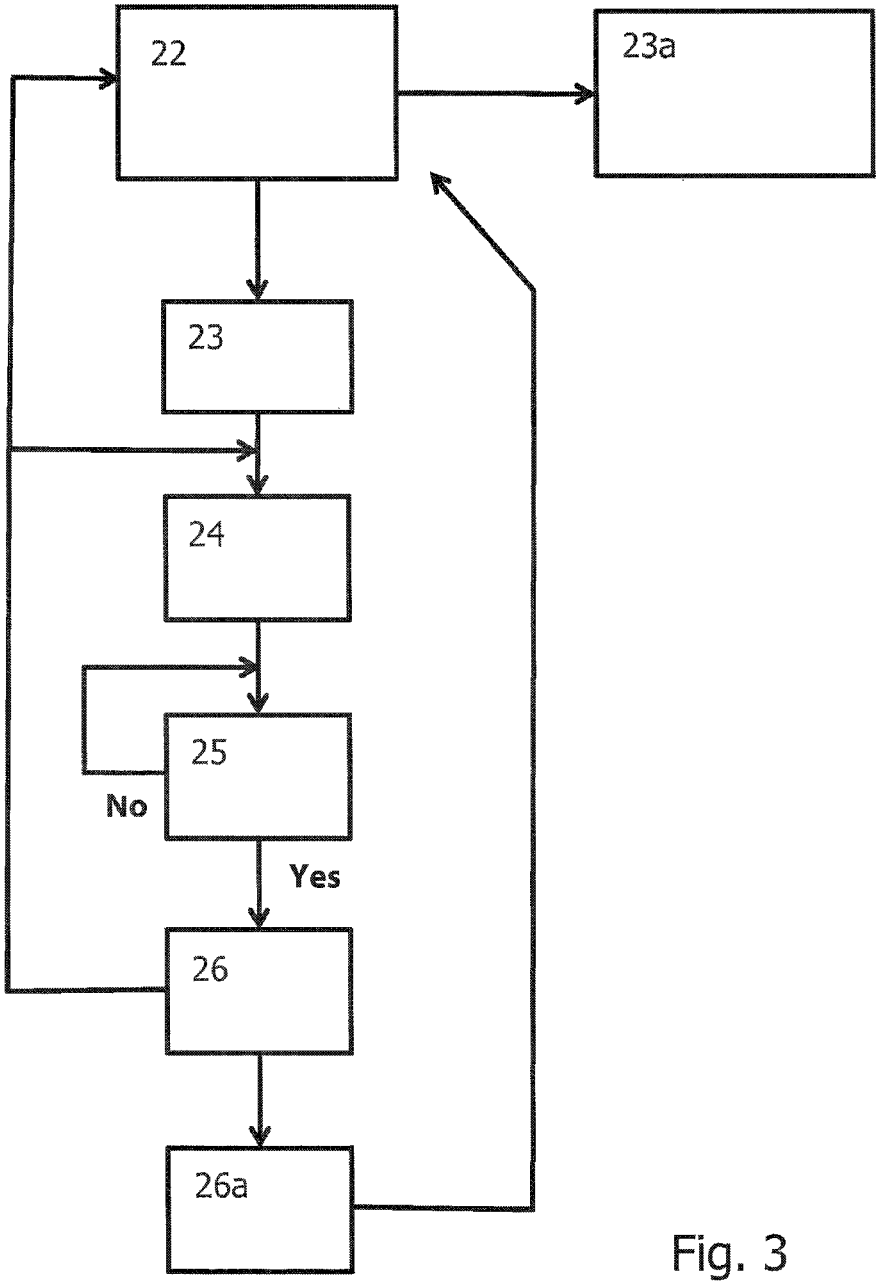
FIG. 3 illustrates an exemplary embodiment of a hot switching procedure for a microphone.

FIG. 3 illustrates an exemplary embodiment of a hot switching procedure for a microphone in combination with a more precise representation of the call procedure.

The procedure begins with a program selection step 22. The program selection step can be performed in the described manner by the communication terminal. Next a selection step 23 is performed where one of the microphones is selected from a provided microphone arrangement for the shooter. This selection can be signaled in a display step 24 by a location display in the area of the shooter. Thus the shooter receives information to which microphone he has to go in order to be able to put in the acoustic throwing command. Simultaneously a selection 23*a* is performed by the control unit wherein one throwing machine is selected from plural provided throwing machines.

Simultaneously the place display that is turned on signals the hot switching of the microphone. It is now detected in an interrogation procedure 25 whether the acoustic call command has been received by the microphone. This interrogation procedure terminates when the acoustic call command has been performed and detected. Then a clay pigeon is being thrown. It is being checked in another test step 26 whether the microphone has detected the bang of a shot. If this is the case the place display is switched off in a step 26*a* and the microphone is deactivated.

For competitions where time limits are set which have to be kept by the individual shooters a time sequencing control can be provided in the sequence plan. When the time has expired and no clay pigeon has been called the respective microphone is deactivated as well.

The sequencing plan then returns to the program selection step 22. In case no shot has been received the microphone is also deactivated after a certain time period. However, the program sequencing returns to the display step 24, wherein the shooter has to wait for the renewed activation of the microphone and the signaling of the place display. Alternatively also here there is an option to interrupt the run of the procedure and to return to the program selection 22.

Figure 4:
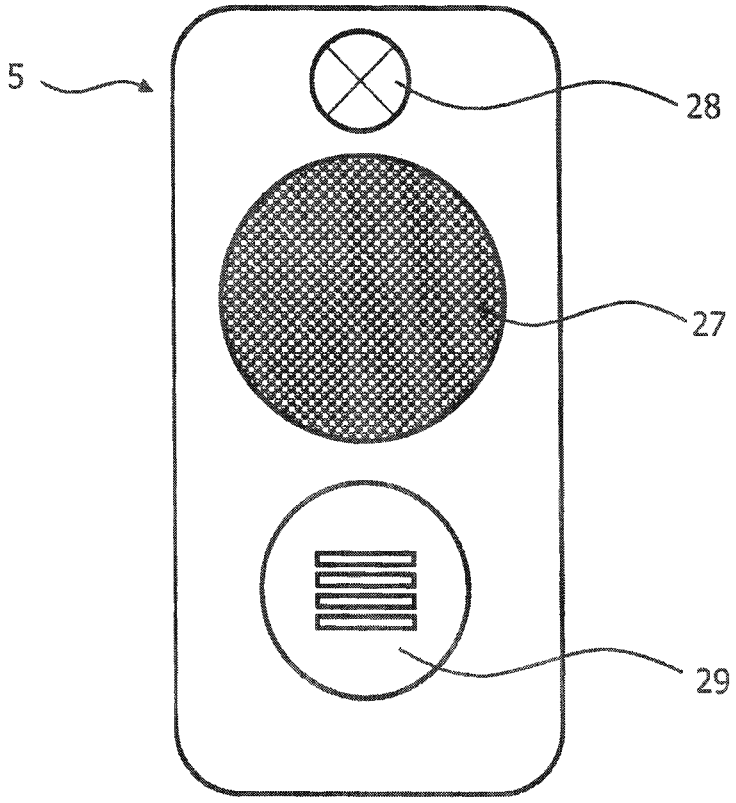
FIG. 4 illustrates an exemplary microphone with a signal light and an acoustic signal generator.

FIG. 4 illustrates an embodiment of a microphone 5 that is adapted to the method. In addition to a typical speaking opening 27 the microphone 5 includes a signal lamp 28 and an acoustic signal generator 29. The speaking opening is used for detecting the acoustic call command. The signal lamp 28 lights up as soon as the microphone has been switched hot. It goes out when the hot switching has been canceled and the microphone has been blocked and the microphone does not receive any acoustic signals. Alternatively also the acoustic generator can be used for putting out the hot switching and the blocking signal. When hot switching the microphone a first signal tone sounds, during the hot switching time an expiration of the time interval or the impending throwing of a clay pigeon can thus be displayed for orienting the shooter for example by a constant interval clicking sound without distracting the shooter from its target area.

Figure 5:
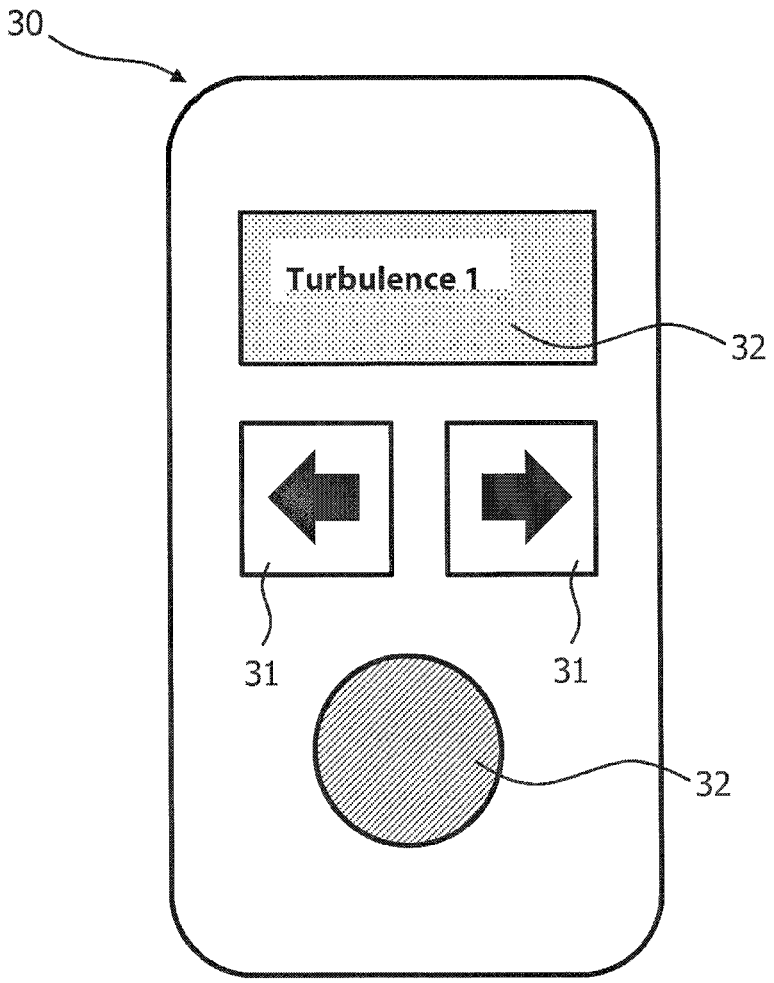
FIG. 5 illustrates a remote for manual triggering.

FIG. 5 illustrates an exemplary remote 30 for manually initiating a throw. This remote can be handed to the shooter when entering the throwing arrangement or it can be installed proximal to the microphone. It facilitates a selection between different throwing programs which can be performed by actuating two selection keys 31. The respectively selected throwing program is indicated on a display 32. The throwing can be triggered by pushing a trigger button 33. The remote represents an alternative operating option for shooters who do not have a mobile terminal. The remote can include a memory with an identifier for personally identifying the shooter and when the remote is actuated the identifier is transmitted to the central control unit and processed in the external management server for performing the consumption accounting as recited supra.

Figure 6:
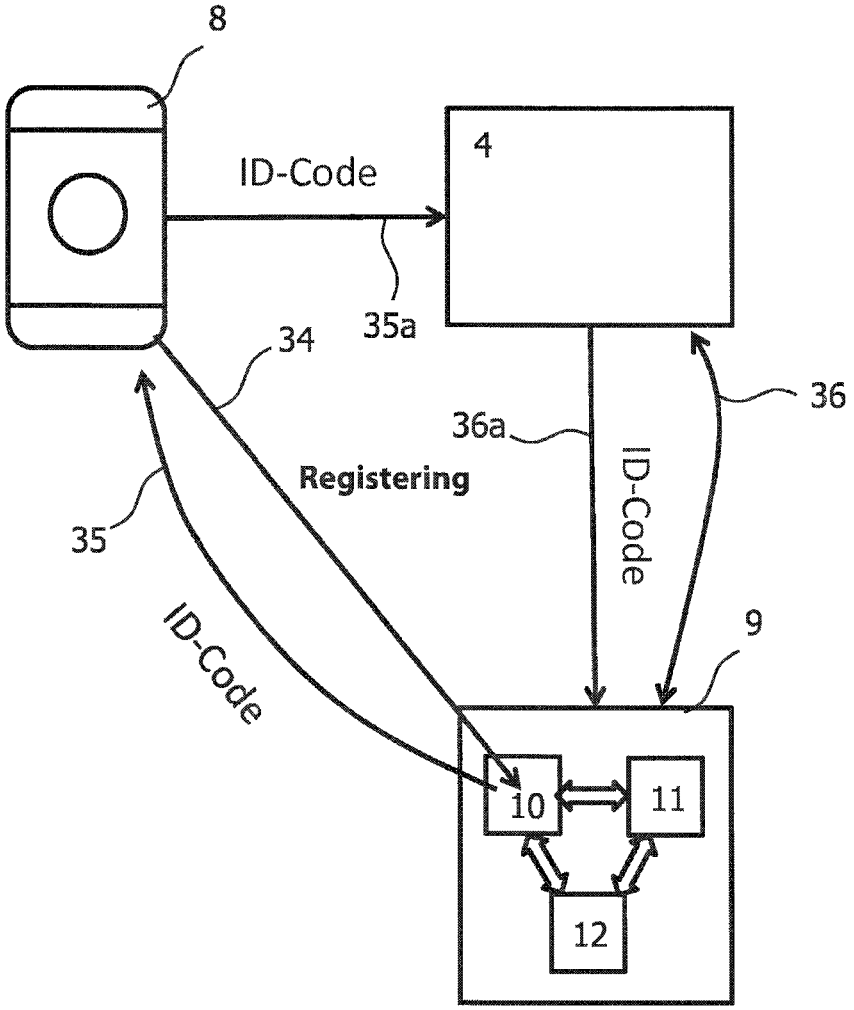
FIG. 6 illustrates an exemplary registering and identification process of a communication terminal at the central control unit and at the external management server.

FIG. 6 illustrates a representation of an exemplary registering and identifying process of a communication terminal at the control unit and at the external management server. During a registration 34 initially a transmission of personal data is performed on the external management server by the stationary communication terminal and in this embodiment by the mobile communication terminal 8. Thereafter, the management server generates a user account with personal data of the shooter in the user account control and thus with an identification code. The identification code is copied and returned to the communication terminal in context with an actuation 35. The other copy of the identification code remains in the external management server 9.

During actuation of the central control unit 4 of the throwing arrangement, this means during clay pigeon shooting an ID code that is stored in the communication server is transmitted to the central control unit of the throwing arrangement in a code transmission 35*a*. The ID code is simultaneously used for clearing the holder of the communication terminal to use the throwing arrangement. Thus, the central control unit can determine from the external management server through a request 36 whether the identification code is actually provided in a generated manner. If this is the case the throwing arrangement is cleared for use.

In a context of transmitting consumption and operating data from the central control unit to the external management server the data is transmitted in conjunction with the communication code of the shooter in a code transmission 36*a*. The consumption and operating data can then be unambiguously associated with a user of the throwing arrangement on the external management server. During the clearance to use the throwing arrangement as well as during the consumption accounting no person related data has to be transmitted between the communication terminal and the central control unit or between the central control unit and the external management server. The clearance and the consumption accounting can thus be provided with a maximum degree of anonymity.

Figure 7:
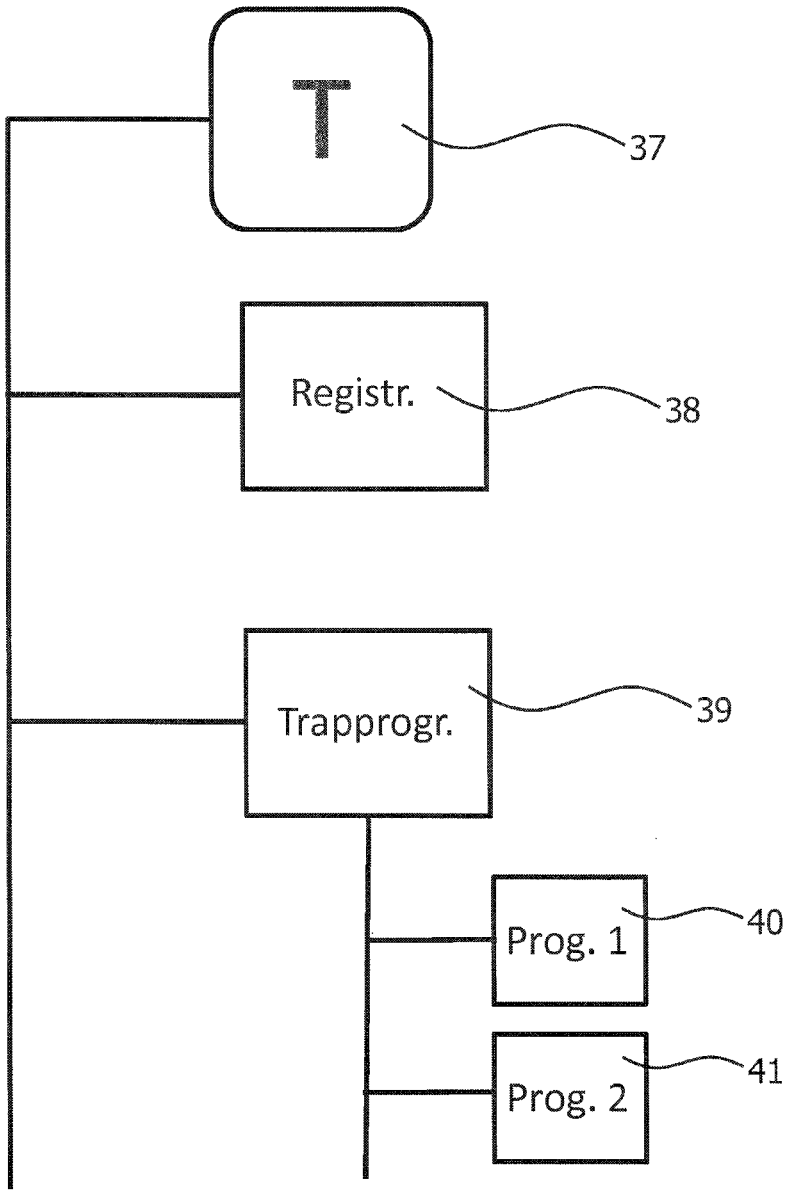
FIG. 7 illustrates an exemplary menu structure of an app installed on the communication terminal.

FIG. 7 illustrates an exemplary structure of an app 37 installed on the communication terminal. The app includes routines 38 for the registering process and a series of trap programs 39 which determine and define the operations of the central control unit as control programs in the manner described supra. Thus, different programs 40, 41 can be optionally downloaded and installed in a supplemental manner on the communication terminal for a fee. The shooter can also assemble a collection of different trap programs for clay pigeon shooting at his discretion on his personal communication terminal and can run them on the throwing arrangement.

Figure 8:
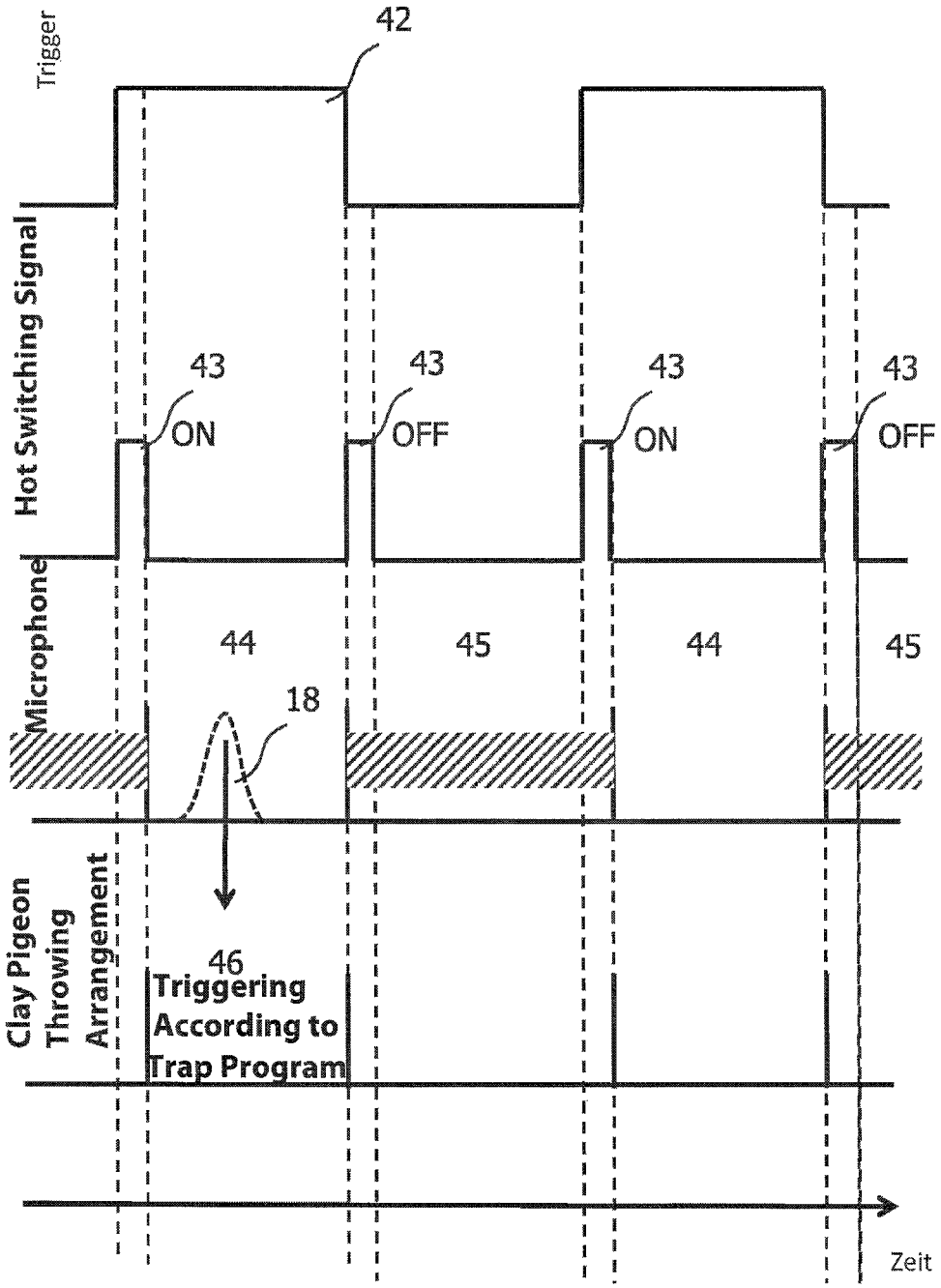
FIG. 8 illustrates an exemplary time diagram of switching and throwing processes.

FIG. 8 illustrates an exemplary time diagram of hot switching and throwing processes and the executed method steps at the various components of the throwing arrangement. The methods thus performed are performed on a basis of a common trigger signal 42. The trigger signal predetermines a cycling for the method steps. In the embodiment recited herein the trigger signal includes a sequence of rectangular impulses which continuously defines two discernable time intervals. The trigger signal forms a basis of the hot switching and throwing sequence in the central control unit. Depending on the control program the trigger signal can be configured differently.

The trigger signal is transposed into a hot switching signal which is transmitted to the respectively requested microphone. The hot switching signal is made up from a series of microphone switching impulses 43 including switch on impulses ON and switch off impulses OFF by which the microphone it either turned on to receive acoustic call commands or deactivated again. Thus, a sequence of time intervals is generated at the microphone 5 wherein the microphone is either in a hot switched condition 44 or in a blocked condition 45 during the time intervals. The respective conditions are displayed at the microphone itself acoustically by a signal tone or optically by a light signal to the shooter. When the microphone is switched hot an acoustic call command 18 can be entered within the interval 44. Thereafter the throwing machine control unit 3 causes the respective throwing machine to perform a throw 46 of a clay pigeon according to the selected trap program. Within the blocked intervals the microphone is switched off so that interference noises at the respective microphone from the ambient do not cause a throw of a clay pigeon whereas additional shooters can trigger a throw of a clay pigeon with an acoustic command at the throwing arrangement at additional microphones. The central control unit thus provides clay pigeons through which the throwing arrangement can be provided for several shooters simultaneously.

The method was described in more detail with reference to exemplary embodiments. Further embodiments can be derived from the dependent claims and are within the skill of a person skilled in the art.

REFERENCE NUMERALS AND DESIGNATIONS

1 throwing machine arrangement
2 throwing machine
3 throwing machine control unit
4 central control unit
5 microphone
6 microphone arrangement
7 stationary communication terminal
8 mobile communication terminal
9 external management server
10 user account data base
11 operations control
12 accounting unit
13 control program
14 transmission control program data
15 confirming report
16 hot switching and throwing sequence
17 activation signal
18 acoustic call command
19 throwing impulse
20 throw control signal
21 throw count signal
22 program selection step
23 microphone selection step
**23*a*** throwing machine selection step
24 display step
25 interrogation profile procedure
26 test step
**26*a*** switch off place display
27 speech opening
28 signal lamp
29 acoustic signal generator
30 remote
31 selection key
32 display
33 triggering button
34 registration
35 confirmation and transmission of identification code
**35*a*** code transmission
36 interrogation
**36*a*** code transmission
37 app
38 routine registration process
39 trap program selection
40 first trap program
41 second trap program
42 trigger signal
43 microphone switching impulse
44 cleared condition
45 blocked condition
46 throw triggering

What is claimed is:

1. A method for operating a throwing system for clay pigeons including at least one throwing machine arrangement (1) respectively including at least one throwing machine (2) and at least one throwing machine control unit (3), a central control unit (4) for controlling the throwing machine arrangement and a microphone arrangement (6) that is connected to the central control unit (4) for acoustically inputting a throwing command, wherein the central control unit (4) performs a wireless and bidirectional data exchange with a stationary communication terminal (7) and/or a mobile communication terminal (8), and the stationary communication terminal and/or the mobile communication terminal and the central control unit perform a data exchange relating to an operation of the throwing system with an external management server (9) for the throwing system through a communication network, wherein the microphone arrangement (6) includes at least one activatable microphone (5), and wherein activating the microphone (5) is indicated by an optical and/or acoustic signal generator (28, 29) that is arranged in a portion of the microphone.

2. The method according to claim 1, characterized in that the stationary and/or mobile communication terminal (7, 8) includes a control program (13) with training sequences that are freely selectable on the communication terminal and operating modes for actuating the central control unit (4).

3. The method according to claim 2, characterized in that the control program (13) performs an authentication and registration routine on the stationary and/or mobile communication terminal (7, 8) through the management server (9), wherein the management server generates an access code for the communication terminal to access the central control unit (4) as a result.

4. The method according to claim 2, characterized in that the control program (13) is configured on the mobile communication terminal (7, 8) as an app.

5. The method according to claim 1, characterized in that during operations of the throwing arrangement a data exchange relating to operations of the throwing arrangement is performed between the stationary and/ or the mobile communication terminal (7, 8) and/or the central control unit (4) and the external management server (9) for personalized operation capture and/or consumption accounting.

6. The method according to claim 1, characterized in that the at least one throwing machine control unit (3) puts out a feedback signal to the central control unit (4) after throwing a clay pigeon, wherein the central control unit sends a feedback signal to the stationary and/or mobile communication terminal (7, 8) and/or to the management server (9) for personalized operating data capture and consumption accounting.

7. A method for operating a throwing system for clay pigeons including at least one throwing machine arrangement (1) respectively including at least one throwing machine (2) and at least one throwing machine control unit (3), a central control unit (4) for controlling the throwing machine arrangement and a microphone arrangement (6) that is connected to the central control unit (4) for acoustically inputting a throwing command, wherein the central control unit (4) performs a wireless and bidirectional data exchange with a stationary communication terminal (7) and/or a mobile communication terminal (8), and the stationary communication terminal and/or the mobile communication terminal and the central control unit perform a data exchange relating to an operation of the throwing system with an external management server (9) for the throwing system through a communication network, wherein the microphone arrangement (6) includes at least one activatable microphone (5), and wherein activating the microphone (5) is indicated by an optical and/or acoustic signal generator (28, 29) that is arranged in a portion of the microphone, wherein the stationary and/or mobile communication terminal (7, 8) includes a control program (13) with training sequences that are freely selectable on the communication terminal and operating modes for actuating the central control unit (4), and wherein the control program (13) transmits a hot switching and throwing sequence (16) to the central control unit (4), wherein an addressing and actuating of the microphone arrangement (6) and/or of the at least one throwing machine control unit (3) is performed by the central control unit according to the hot switching and throwing sequence.

8. The method according to claim 7, characterized in that the hot switching and throwing sequence (16) causes an activation of a sound and/or light signal output at the stationary and/or mobile communication terminal (7, 8) to signal individual operating conditions of the throwing arrangement.

9. A method for operating a throwing system for clay pigeons including at least one throwing machine arrangement (1) respectively including at least one throwing machine (2) and at least one throwing machine control unit (3), a central control unit (4) for controlling the throwing machine arrangement and a microphone arrangement (6) that is connected to the central control unit (4) for acoustically inputting a throwing command, wherein the central control unit (4) performs a wireless and bidirectional data exchange with a stationary communication terminal (7) and/or a mobile communication terminal (8), and the stationary communication terminal and/or the mobile communication terminal and the central control unit perform a data exchange relating to an operation of the throwing system with an external management server (9) for the throwing system through a communication network, wherein the microphone arrangement (6) includes at least one activatable microphone (5), and wherein activating the microphone (5) is indicated by an optical and/or acoustic signal generator (28, 29) that is arranged in a portion of the microphone, wherein the stationary and/or mobile communication terminal (7, 8) includes a control program (13) with training sequences that are freely selectable on the communication terminal and operating modes for actuating the central control unit (4), wherein the control program (13) transmits a hot switching and throwing sequence (16) to the central control unit (4), wherein an addressing and actuating of the microphone arrangement (6) and/or of the at least one throwing machine control unit (3) is performed by the central control unit according to the hot switching and throwing sequence, and wherein the hot switching and throwing sequence (16) causes an activation of at least one microphone (5) of the microphone arrangement (6) during a predeterminable time interval to cause reception readiness for an acoustic throwing command.

* * * * *